US007438059B2

(12) United States Patent
Mills et al.

(10) Patent No.: US 7,438,059 B2
(45) Date of Patent: Oct. 21, 2008

(54) EVAPORATIVE EMISSION CONTROL SYSTEM AND METHOD FOR SMALL ENGINES

(75) Inventors: Vaughn K. Mills, Chelsea, MI (US); Peter G. Belanger, Ann Arbor, MI (US); Andrew W. McIntosh, Ann Arbor, MI (US)

(73) Assignee: Eaton Corporation, Cleveland, OH (US)

( * ) Notice: Subject to any disclaimer, the term of this patent is extended or adjusted under 35 U.S.C. 154(b) by 142 days.

(21) Appl. No.: 11/072,368

(22) Filed: Mar. 4, 2005

(65) Prior Publication Data

US 2006/0196481 A1 Sep. 7, 2006

(51) Int. Cl.
*F02M 37/04* (2006.01)

(52) U.S. Cl. ..... 123/519; 123/516

(58) Field of Classification Search ..... 123/516, 123/518, 520, 521, 514, 456, 519
See application file for complete search history.

(56) References Cited

U.S. PATENT DOCUMENTS 4,646,701 A * 3/1987 Fukumoto ..... 123/519
4,714,172 A * 12/1987 Morris ..... 220/86.2
5,193,512 A * 3/1993 Steinbrenner et al. ..... 123/520
5,259,355 A * 11/1993 Nakashima et al. ..... 123/520
5,389,245 A * 2/1995 Jaeger et al. ..... 210/129
5,570,672 A * 11/1996 Kunimitsu et al. ..... 123/516
5,651,350 A * 7/1997 Blomquist et al. ..... 123/520
5,657,734 A * 8/1997 Sawamoto et al. ..... 123/519
5,669,361 A * 9/1997 Weissinger et al. ..... 123/520
5,868,119 A * 2/1999 Endo et al. ..... 123/516
6,176,259 B1 * 1/2001 Harde et al. ..... 137/587
7,234,452 B2 * 6/2007 Mills ..... 123/516
2002/0088439 A1 * 7/2002 Distelhoff et al. ..... 123/516

* cited by examiner

*Primary Examiner*—Carl S Miller
(74) *Attorney, Agent, or Firm*—Anna M. Shih

(57) ABSTRACT

A small engine fuel tank vapor emission system is described with a separate surge tank having a vapor vent/rollover valve and separate a vapor storage space which may be found in a common housing or remote from the surge tank. The surge tank is located at a level above the fuel tank and is connected to have its inlet receive vapor from the fuel tank. The outlet of the vapor vent/rollover valve is connected to supply vapor purge flow to the engine air inlet either directly or through the storage space, which may be charged with adsorbent.

10 Claims, 4 Drawing Sheets

EVAPORATIVE EMISSION CONTROL SYSTEM AND METHOD FOR SMALL ENGINES

BACKGROUND

The present specification, drawings and claims relate to fuel evaporative emission control in small internal combustion engines and particularly engines of less than about 50 horsepower (37.2 kilowatts) of the type used for e.g., applications in garden tractors, lawn mowers, generator sets and other portable appliances and marine applications.

Engine applications of the aforesaid type commonly have the fuel tank located proximate the engine for compactness. The fuel tanks employed in such applications usually have a user removable filler cap which contains a vent for permitting make-up air to enter the tank as the fuel is used by the engine. In such applications, the fuel feed is by gravity flow from the tank to the engine carburetor or in some applications by a small fuel pump. Furthermore, in such applications the engine is normally refueled in situ rather than at a refueling station; and, the fuel is poured into the tank from a portable container and quite often with the use of a user-supplied funnel or temporary pouring spout provided with the fuel container.

Recently, it has been mandated that fuel vapor from such small engine fuel systems not be permitted to escape to the atmosphere and that the fuel system including connections to the engine be sealed and prevent emission of fuel vapor to the atmosphere when the engine is not running; and, that when the engine is in operation the fuel vapor be drawn into the engine air inlet.

It is desired to provide for controlling emission in a small engine without requiring complete redesign of the fuel tank and fuel supply system for the small engine. In addition, it is desired to provide for controlling fuel vapor emission in a small engine in a manner which is low in cost and simple to incorporate in mass production of such engines and the appliances into which they are installed. It is further desired to facilitate the incorporation of vapor emission control for small engines with the fuel tank disposed proximate the engine without requiring redesign and retooling for the manufacturer of the tank and the associated components of the engine fuel system.

BRIEF SUMMARY

The present specification, drawing and claims describe a solution to the above-described problem where in one embodiment a separate tank structure defining a vapor space for allowing expansion of fuel vapor has integrally therewith a fuel vapor vent/rollover valve associated with the tank structure. The vapor space may have an outlet connected to the engine air inlet for effecting purging of the fuel vapor in the vapor space upon engine startup. In the aforesaid embodiment the tank structure is separate or remote from the fuel tank; and, in another embodiment a fuel vapor storage device such as an adsorbent filled canister is disposed in the line from the vent/rollover valve to the engine air inlet. In a further embodiment the tank structure defining the vapor space and the storage device containing the adsorbent are formed in a common housing. The vapor storage space may be connected either directly through the wall of the tank or through the fuel filler closure for receiving fuel vapor from the fuel tank.

DETAILED DESCRIPTION

Figure 1:
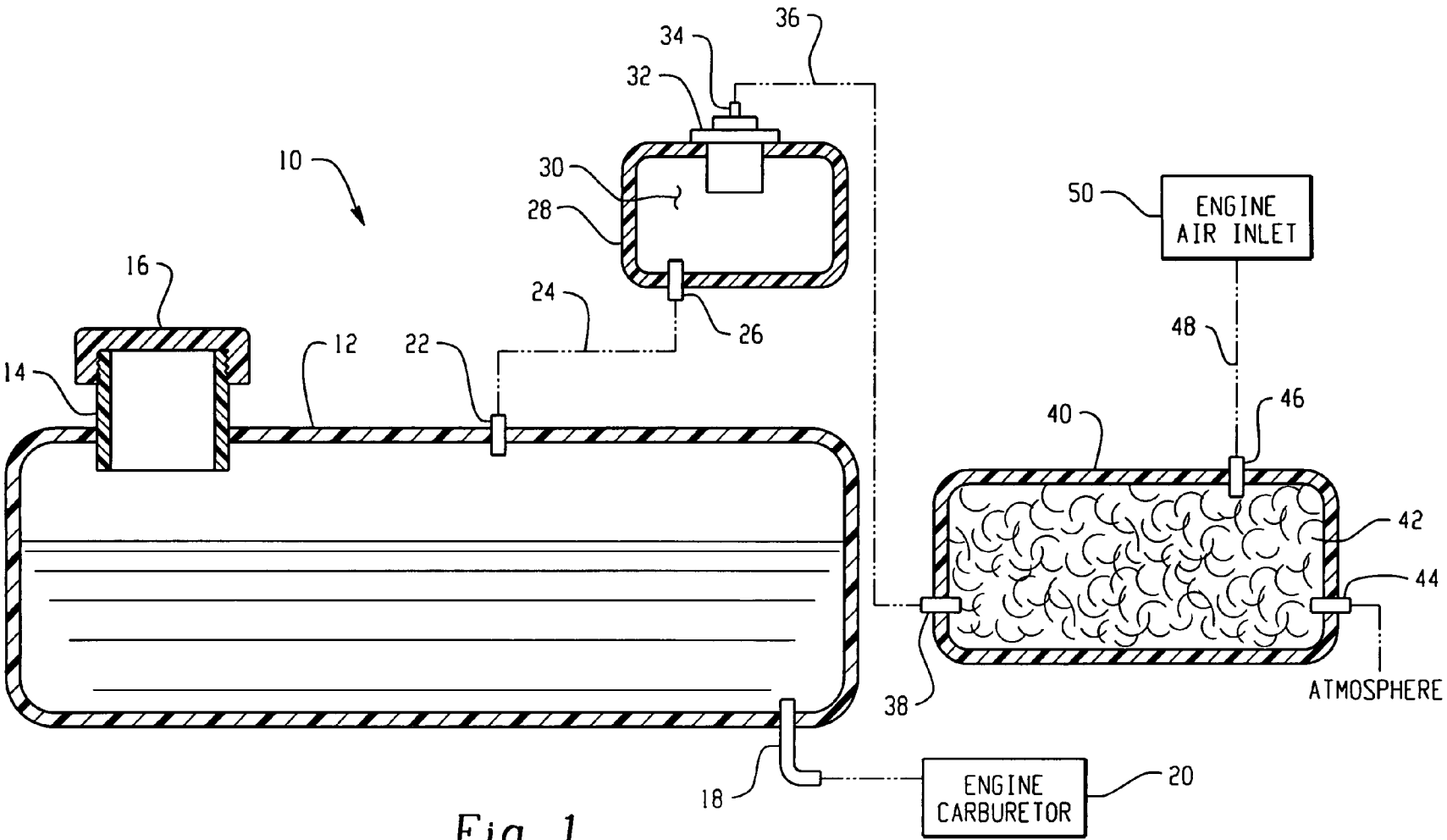
FIG. 1 is a pictorial schematic of a small engine fuel tank and vapor emission control system in an exemplary embodiment employing a storage canister.

Referring to FIG. 1, an exemplary embodiment is indicated generally at 10 with a fuel tank 12 having a filler tube or spud 14 with a user removable closure or cap 16 which may be threadedly engaged with the upper end of the tube 14. A tank 12 has a gravity feed fuel line 18 tapped into the lower wall of the tank for supplying fuel to the engine carburetor as indicated by reference number 20.

A fuel vapor conduit 24 has one end 22 connected through the upper wall of the tank to communicate with the interior thereof; and, the opposite end 26 of conduit 24 is connected to tank structure 28 defining a vapor space 30 which is disposed at a level above the fuel tank to function as a liquid surge tank in the event of sloshing or inversion of fuel tank 12. Tank 28 has a vent/rollover valve 32 associated therewith so as to have the inlet thereof receive vapor or liquid fuel from the space 30; and, the outlet thereof is connected to one end 34 of conduit 36, with the opposite end 38 of conduit 36 connected to the interior of a storage device or canister 40. Canister 40 may contain adsorbent 42 such as carbonaceous particulate material. The canister 40 has an atmospheric air inlet 44 and a vapor purge outlet 46 comprising one end of a conduit 48 which has its opposite end connected to the engine air inlet as denoted by reference numeral 50.

In the embodiment 10 of FIG. 1 the tank structure 28 is located at a level above the fuel tank 12; whereas, the separate canister 40 may be located at any convenient location as for example at a level approximate that of or slightly below fuel tank 12. In operation, vent/rollover valve 32 may be of a float operated and gravity operated type and controls flow of vapor to the canister 40 and hence the engine air inlet 50 during purge; and, valve 32 closes in the event of inversion of the fuel tank and tank structure 28.

Figure 2:
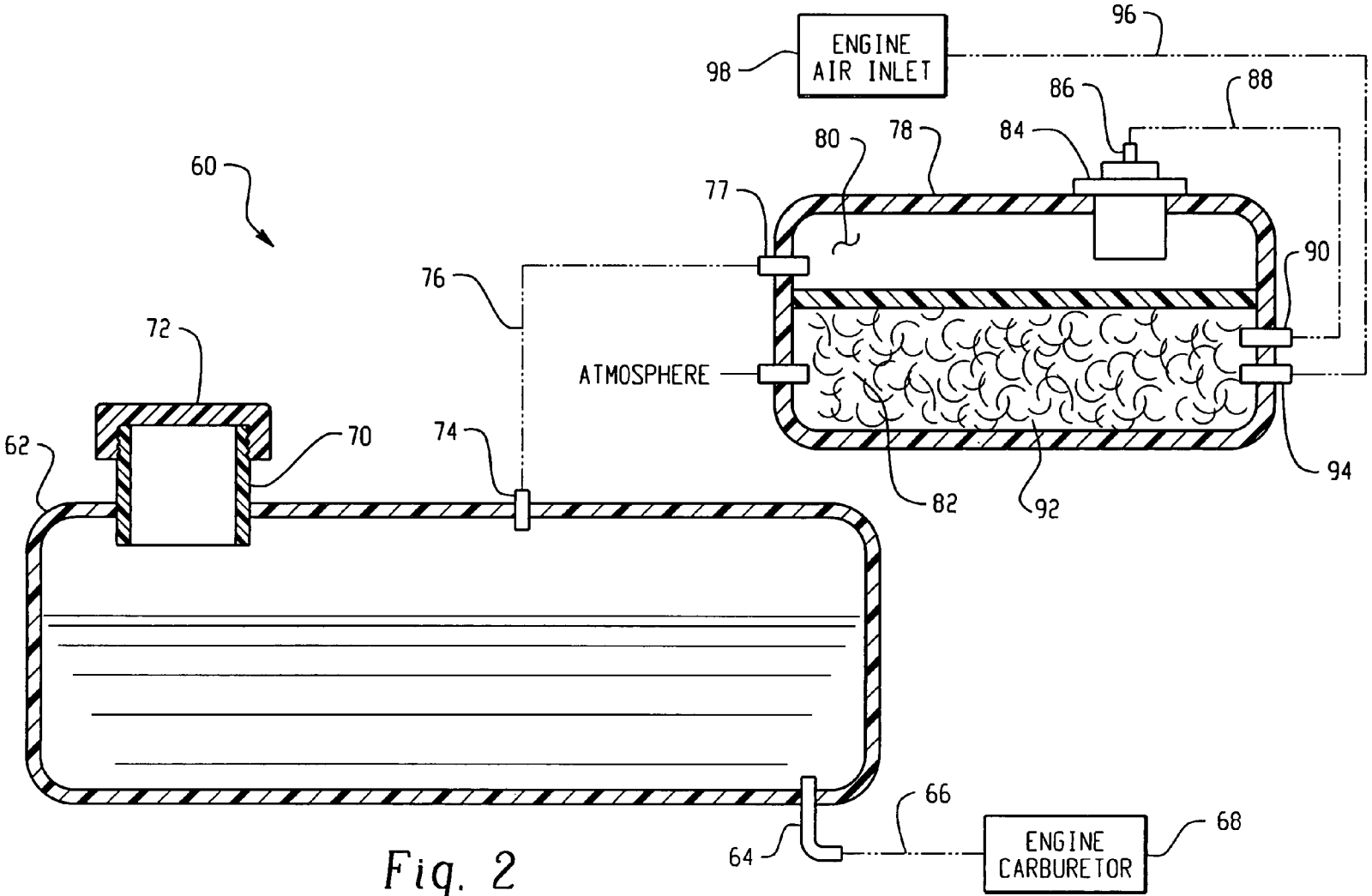
FIG. 2 is another embodiment of the invention having the tank structure defining the vapor space formed in a common housing.

Referring to FIG. 2, another embodiment is indicated generally at 60 is illustrated and includes a fuel tank 62 with a gravity feed fuel line 64 connected to the bottom thereof which communicates through conduit 66 to the engine carburetor as indicated by reference number 68. The tank has a filler tube or spud 70 disposed on the upper surface thereof with a user removable closure or cap 72 which, when in place, seals the upper end of filler tube 70.

Tank 62 has one end 74 of a vapor vent line 76 connected through the upper wall of the tank for communicating with the interior thereof; and, the opposite end 78 of the conduit 76 is connected through fitting 77 to tank structure 78 which forms therein a vapor space 80.

The tank structure 78 may be formed in a common housing which also defines a separate vapor storage chamber 82. The vapor space 80 has associated therewith through the upper wall of the tank structure 78 a vapor vent/rollover valve 84 which has its inlet communicating with vapor space 80 and its outlet 86 connected to one end of a conduit 88 which has its opposite end 90 connected through the tank structure wall to storage space 82. If desired, a storage space 82 may contain an adsorbent 92 such as particulate carbonaceous material. The storage space 82 has one end 94 of a conduit 96 communicating therewith; and, the opposite end of the conduit 96 is connected to the engine air inlet denoted by reference numeral 98.

It will be understood that in the embodiment 60 of FIG. 2, the tank structure 78 defining the vapor space 80 and the storage space 82 is located above the fuel tank 62.

Figure 3:
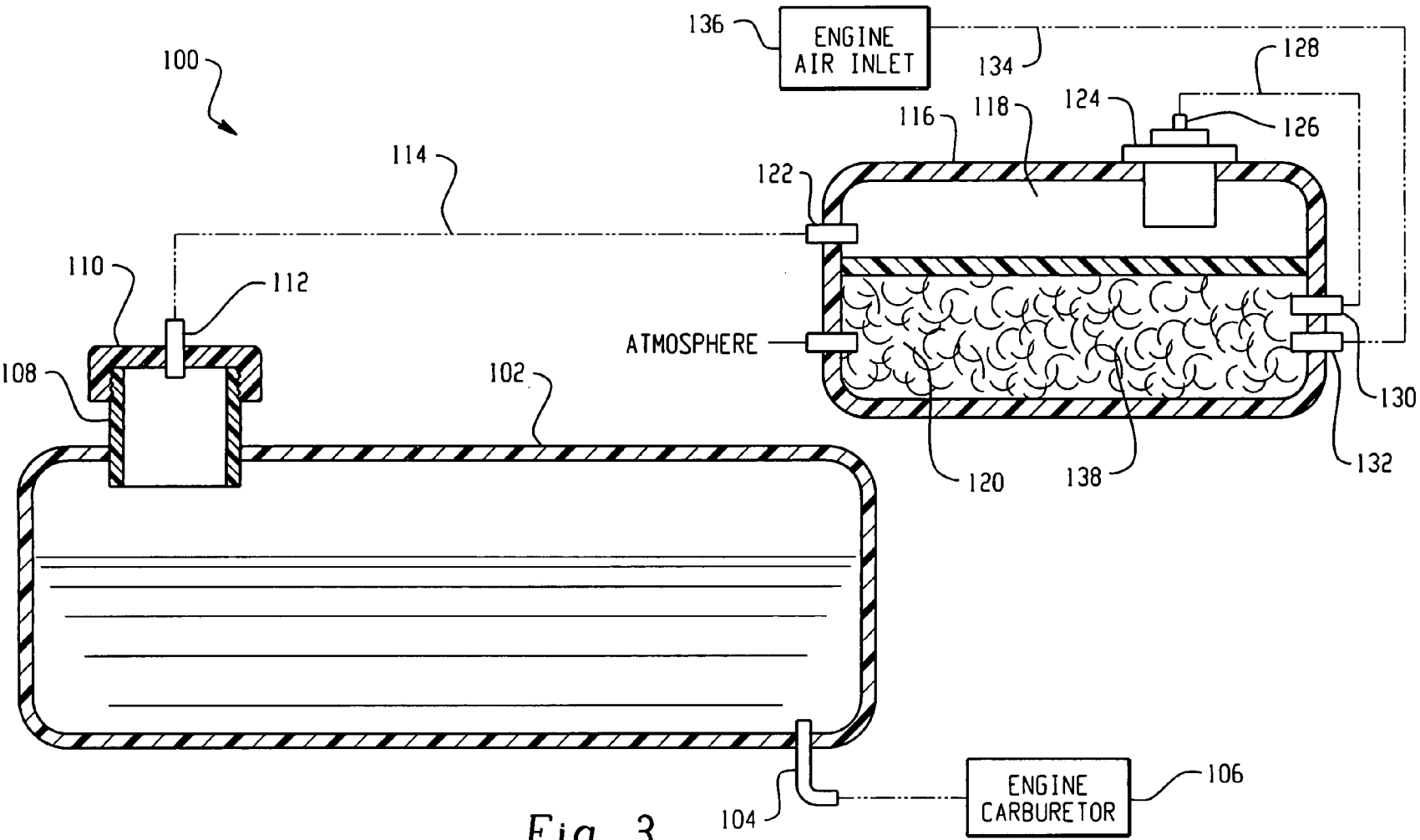
FIG. 3 is another embodiment similar to that of FIG. 2 wherein the vapor space receives fuel vapor from a connection through the fuel tank filler closure.

Referring to FIG. 3, another embodiment is indicated generally at 100 and includes a fuel tank 102 with a fuel line 104 disposed in the bottom thereof for gravity feed of fuel to an engine carburetor denoted by reference numeral 106. Tank 102 has a filler tube or spud 108 provided in the upper wall thereof which filler tube has a user removable closure or cap 110 for facilitating refueling. Cap 110 has one end 112 of the conduit 114 connected thereto with the opposite end of the conduit 114 connected to a modular canister 116 which defines a vapor space or surge tank 118 and also defines, in a common housing 116 a separate storage space 120 isolated from the vapor space 118. The end 122 of conduit 114 opposite end 112 is connected to the vapor space 118.

The vapor space 118 has associated therewith a vapor vent/rollover valve 124 which has its inlet receiving vapor from the space 118 and the outlet 126 thereof, connected to one end of a conduit 128 which has its opposite end 130 connected to communicate with the storage space 120 through the wall of housing 116. The embodiment 100 of FIG. 3 thus simplifies the connection of the modular canister and vapor space to the tank by providing the connection through the filler cap rather than requiring a separate fitting and access hole to be formed in the tank wall.

In the embodiment 100, the modular canister 116 is disposed at a level above the tank 102 such that if the fuel tank 102 is completely filled, liquid does not enter the vapor space 118. However, in the event of inversion of the tank 102, liquid entering the vapor space 118 is trapped therein by closure of the rollover protection functions of valve 124, description of which is omitted for the sake of brevity.

Figure 4:
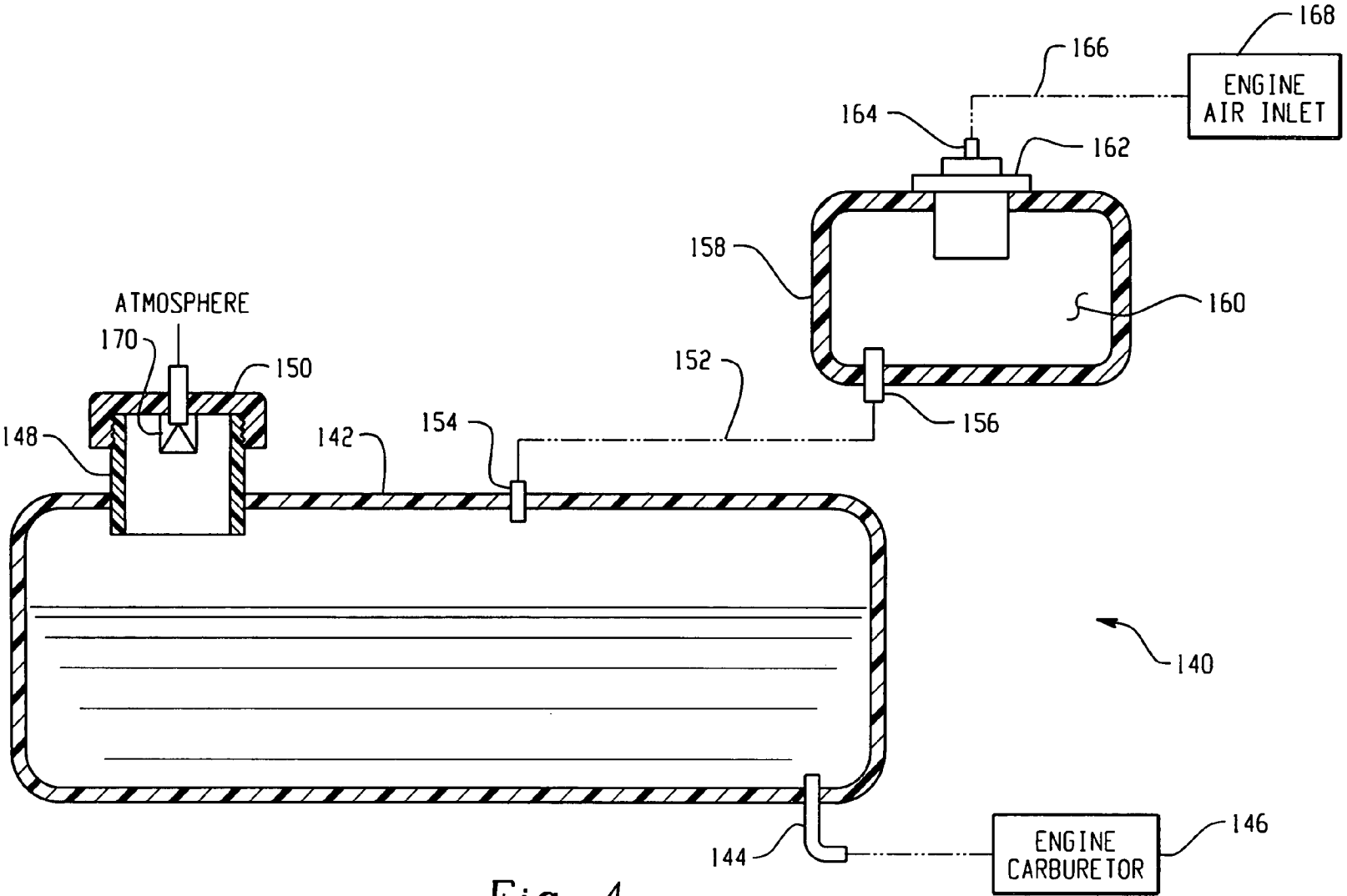
FIG. 4 is another embodiment with the tank structure defining vapor space with a vent/rollover valve connected directly to the engine air inlet with a one-way atmospheric valve disposed in the tank filler closure.

Referring to FIG. 4, another embodiment is indicated generally at 140 and includes a fuel tank 142 having a fuel line 144 connected to the bottom thereof for gravity feed to an engine carburetor 146. The tank 142 has a filler neck or spud 148 with a user removable closure or cap 150 which has mounted thereon a one way valve 170 for admitting atmospheric make up air as fuel is withdrawn from the tank.

A vapor conduit 152 has one end 154 connected through the upper wall of the tank 142, with the opposite end 156 connected through the wall of a surge tank 158 which defines therein vapor space 160 and which has a vapor vent/rollover valve 162 associated therewith and disposed through the upper wall thereof. The outlet 164 of valve 162 is connected to one end of a conduit 166 which has opposite end thereof connected to the engine air inlet as indicated by reference numeral 168. In the embodiment 140, surge tank 158 is located at an elevation above the tank 142 to prevent liquid fuel from entering the vapor space 160 when the tank is completely filled with fuel.

The various exemplary embodiments illustrated herein provide a simple and relatively low cost vapor emission control system for a small engine of the type having the tank mounted proximate the engine and with a user removable closure for the tank filler. The illustrated embodiments provide for a vapor expansion space and may include storage space filled with adsorbent material. The system retains vapor until the engine is operated whereupon the vapor is purged the engine air inlet.

Although certain embodiments have been hereinabove described and illustrated, it will be understood that modifications and variations may be made by those having ordinary skill in the art within the scope of the following claims.

What is claimed is:

1. An evaporative emission control system for a small internal combustion engine with the fuel tank disposed proximate the engine comprising:

a user-removable filler closure for the fuel tank;

a tank structure defining a vapor space including a vapor conduit connecting the fuel tank with said vapor space, wherein the vapor space acts as a surge tank;

a rollover/vent valve disposed with an inlet thereof communicating with said vapor space;

a purge conduit defining a path communicating with an outlet of the valve with an air inlet of the engine;

a storage device disposed in the path communicating with the outlet of the valve and the inlet of the engine, wherein the tank structure and the storage device are disposed in a common housing; and, a passage that admits atmospheric air to the system.

2. The system defined in claim 1, wherein said storage device includes adsorbent material.

3. The system defined in claim 1, wherein said vapor space is disposed at a level above said fuel tank.

4. The system defined in claim 1, wherein said vapor conduit is connected to said filler closure.

5. The system defined in claim 1, wherein said vapor space is disposed above said fuel tank and said purge conduit includes a storage device which is not.

6. The system defined in claim 1, further comprising a one-way valve disposed in the passage that admits atmospheric air.

7. A method of controlling evaporative emission for a small internal combustion engine with the fuel tank disposed proximate the engine comprising:

providing a user removable filler closure for the fuel tank;

disposing a tank structure defining a vapor space above the fuel tank and connecting the vapor space to the fuel tank, wherein the vapor space acts as a surge tank;

disposing a rollover/vent valve with said tank structure and connecting an inlet of the valve with said vapor space;

connecting an outlet of said valve to an air inlet of the engine to form a purge flow path and purging the vapor space when the engine is running;

disposing a vapor storage device and the tank structure in a common housing;

disposing the vapor storage device in the purge flow path; and, admitting atmospheric air to said system during purging.

8. The method defined in claim 7, further comprising disposing vapor adsorbent in the storage device.

9. The method defined in claim 7, wherein said step of connecting the vapor space to the fuel tank includes connecting said vapor space to the filler closure.

10. The method defined in claim 7, wherein said step of admitting atmospheric air includes disposing a one-way valve in an atmospheric air inlet.

* * * * *